US008001900B2

(12) United States Patent
Kimura et al.

(10) Patent No.: US 8,001,900 B2
(45) Date of Patent: Aug. 23, 2011

(54) HOME POSITION STORAGE UNIT AND HOME POSITION STORAGE METHOD FOR USE WITH PRINTING PRESS

(75) Inventors: Kenta Kimura, Hiroshima-ken (JP); Takahiko Nakamura, Hiroshima-ken (JP)

(73) Assignee: RYOBI Ltd., Fuchu-shi, Hiroshima-ken (JP)

( * ) Notice: Subject to any disclaimer, the term of this patent is extended or adjusted under 35 U.S.C. 154(b) by 957 days.

(21) Appl. No.: 11/902,418

(22) Filed: Sep. 21, 2007

(65) Prior Publication Data

US 2008/0072776 A1 Mar. 27, 2008

(30) Foreign Application Priority Data

Sep. 26, 2006 (JP) ..... P2006-260775

(51) Int. Cl.
*B41L 3/08* (2006.01)
*B41F 5/00* (2006.01)

(52) U.S. Cl. ..... 101/486; 101/216

(58) Field of Classification Search ..... 101/216, 101/248, 415.1
See application file for complete search history.

(56) References Cited

U.S. PATENT DOCUMENTS

| | | | | |
|---|---|---|---|---|
| 4,785,733 | A * | 11/1988 | Hartung et al. | 101/181 |
| 5,479,859 | A * | 1/1996 | Lindner et al. | 101/485 |
| 6,298,778 | B1 * | 10/2001 | Onodera et al. | 101/232 |
| 6,356,293 | B1 * | 3/2002 | Chiba | 347/262 |
| 6,718,872 | B2 * | 4/2004 | Kanno | 101/118 |
| 2003/0133132 | A1 | 7/2003 | Kiermeier et al. | |
| 2004/0174574 | A1 * | 9/2004 | Okuda | 358/504 |
| 2006/0144263 | A1 * | 7/2006 | Ashikagaya | 101/118 |

FOREIGN PATENT DOCUMENTS

| | | |
|---|---|---|
| DE | 195 04 585 | 8/1996 |
| DE | 298 04 067 | 5/1998 |
| EP | 0 726 146 | 10/1998 |
| JP | 2704558 | 10/1997 |

* cited by examiner

*Primary Examiner* — Ren Yan
*Assistant Examiner* — Allister Primo
(74) *Attorney, Agent, or Firm* — Drinker Biddle & Reath LLP

(57) ABSTRACT

A home position sensor, which constitutes a portion of a home position storage unit, stores a home position by means of previously detecting the position of a printing cylinder cam. Accordingly, a printing cylinder comes to a stop at a plate replacement position at the time of replacement of a plate even when the printing cylinder cam does not pass by the home position sensor.

7 Claims, 4 Drawing Sheets

HOME POSITION STORAGE UNIT AND HOME POSITION STORAGE METHOD FOR USE WITH PRINTING PRESS

CROSS-REFERENCE TO RELATED APPLICATION

This application claims priority from Japanese Patent Application No. 2006-260775, filed on Sep. 26, 2006, the entire subject matter of which is incorporated herein by reference.

BACKGROUND OF THE INVENTION

1. Field of the Invention

The present invention relates to a home position storage unit and a home position storage method for bringing a printing cylinder into a stop at an appropriate plate replacement position during operation for replacing a plate of the printing press.

2. Description of the Related Art

In the recent printing industry, great needs for high-value-added, small batches of a variety of products exist, and a shorter delivery time is strongly requested. In such a trend, a shorter print preparation time as well as speedup in printing operation are required of the printing press. Under circumstances of the great needs for small batches of a variety of products, opportunities for replacement of a plate have increased more than ever. Shortening a time to replace a plate has hitherto posed a problem. In order to solve this problem, Japanese Patent No. 2704558 discloses a technique for automatically replacing a plate.

As described in Japanese Patent No. 2704558, in a printing press that automatically replaces a plate, a printing cylinder needs to be stopped at an appropriate plate detachment position or an appropriate plate attachment position with respect to a rotating direction, in order to perform removal or supply of a plate. Although not described in Japanese Patent No. 2704558, there is operation for storing the home position of a printing cylinder in order to stop the printing cylinder at the plate replacement position. This operation is for, when a command for automatically replacing a plate is issued to the printing press, accurately ascertaining the rotating position of the printing cylinder and bringing the printing cylinder into a stop at an appropriate plate replacement position by means of: detecting passage of a cam provided on the rotating printing cylinder through use of home position sensors provided on respective printing units; and extracting detection information from a position sensor for detecting a pulse from an encoder that produces a pulse in synchronism with rotation of a driving device of the printing press achieved at the time of detection of the passage. Since the printing cylinder has a mechanism for finely adjusting a top-and-bottom direction and others, as a result of performance of fine adjustment, a relative position between the cam provided on the printing cylinder and the home position sensor changes before and after fine adjustment, thereby ending in a failure to bring the printing cylinder into a stop at an appropriate plate replacement. Accordingly, the home position must be stored every time a plate is automatically replaced. In addition, even when the operator has opened covers of respective printing units, and the printing cylinders cannot come to a stop at the appropriate plate replacement position. Hence, the home positions must be stored. In relation to storage of the home position, the home position is stored, under the related-art method, every time a command for automatic replacement of a plate is issued. However, this means that the home position cannot be stored unless the cam provided on the printing cylinder passes by the home position sensor after issuance of the command for automatic replacement of a plate. There has been a problem of automatic replacement of a plate involving consumption of much time and being contrary to the desire for a shorter preparation time for printing.

SUMMARY OF THE INVENTION

The present invention provides a home position storage unit and a home position storage method for use with a printing press which enable shortening of a time for replacement of a plate.

According to a first aspect of the invention, there is provided a printing press including: a printing unit including a printing cylinder that is capable of replacing a plate; a driving device that drives the printing unit; a position sensor that detects a signal output in synchronism with rotation of the driving device and generates position information including an amount of rotation of the driving device; a home position sensor provided on the printing unit to detect a position of the printing cylinder in a rotating direction of the printing cylinder; and a home position storage unit that stores a home position of the printing cylinder by means of extracting position information generated by the position sensor at a point when the home position sensor has detected the position of the printing cylinder, wherein the home position storage unit stores the home position before an issuance of a command for replacement of a plate.

According to a second aspect of the invention, the position information at a point when the home position sensor has detected the position of the printing cylinder is extracted a plural number of times, and the home position storage unit stores the home position when the plural number of extracted position information are identical.

According to a third aspect of the invention, the home position storage unit stores the home position when the plural number of extracted position information are continuously identical.

According to a fourth aspect of the invention, the home position storage unit stores the home position when at least three extracted position information are identical.

According to a fifth aspect of the invention, the home position storage unit stores the home position when the printing press is in idle state.

According to a sixth aspect of the invention, there is provided a home position storing method for use with a printing press, wherein the printing press including: a printing unit including a printing cylinder that is capable of replacing a plate; a driving device that drives the printing unit; a position sensor that detects a signal output in synchronism with rotation of the driving device and generates position information including an amount of rotation of the driving device; and a home position sensor provided on the printing unit to detect the position of the printing cylinder in a rotating direction of the printing cylinder, wherein the method includes: storing a home position of the printing cylinder by means of extracting position information generated by the position sensor at a point when the home position sensor has detected the position of the printing cylinder, the home position being stored before an issuance of a command for replacement of a plate.

According to a seventh aspect of the invention, the storing the home position includes: extracting the position information at a point when the home position sensor has detected the position of the printing cylinder a plural number of times; and storing the home position when the plural number of extracted position information are identical.

According to an eighth aspect of the invention, the home position is stored when the plural number of extracted position information are continuously identical.

According to a ninth aspect of the invention, the home position is stored when at least three extracted data are identical.

DETAILED DESCRIPTION OF THE PREFERRED EMBODIMENTS

Figure 1:
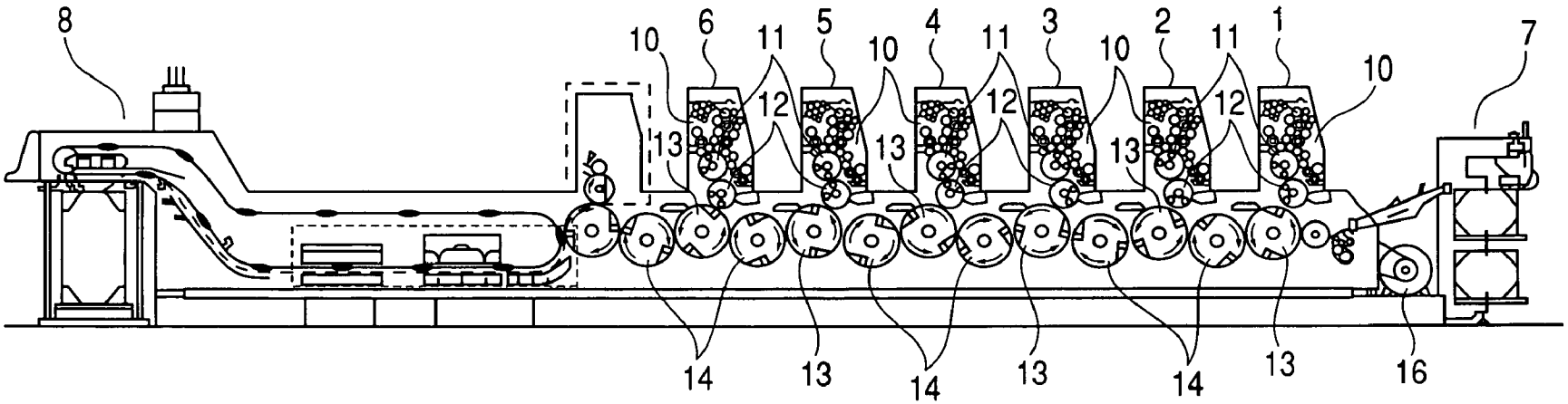
FIG. 1 is an exemplary schematic side cross-sectional view of a sheet-fed offset printing press according to an embodiment of the present invention.

A printing press of an embodiment of the present invention will be described by reference to FIGS. 1 through 4. As can be seen from an exemplary schematic view shown in FIG. 1, a sheet-fed offset printing press of the present embodiment includes a first unit 1, a second unit 2, a third unit 3, a fourth unit 4, a fifth unit 5, and a sixth unit 6 which serve as printing sections. A sheet fed from a sheet-feeding section 7 is printed by these respective units 1 to 6, and the printed sheet is discharged to a sheet discharge section 8. Reference numeral 16 denotes a driving device for driving the printing press.

Each of the printing units 1 through 6 has an ink roller group 10 including a plurality of ink rollers, a printing cylinder 11, a blanket cylinder 12, and an impression cylinder 13. In the ink roller group 10, respective ink rollers rotate and make a slidable contact with each other in order to feed ink stored in an ink reservoir 10*a* to the printing cylinder 11. Reference numeral 14 denotes bridge cylinders that are interposed between the respective impression cylinders 13 of the units 1 through 6 and which have the function of passing to the next impression cylinder 13 a sheet printed between the blanket cylinder 12 and the impression cylinder 13.

Figure 2:
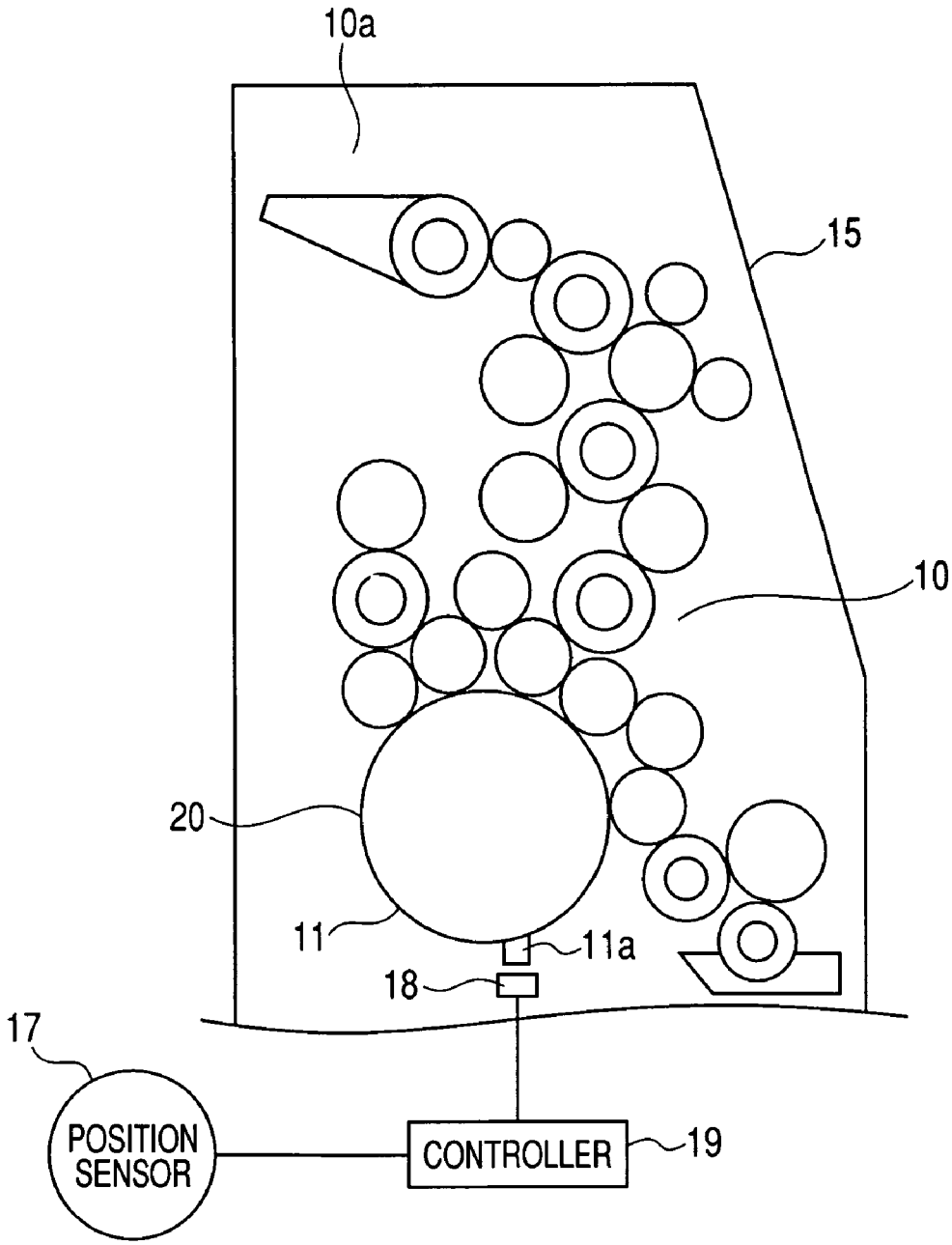
FIG. 2 is an enlarged view of the principal section of the sheet-fed offset printing press shown in FIG. 1.

As shown in FIG. 2, each of the units 1 through 6 has a cover 15. The cover 15 covers the ink roller group 10, the printing cylinder 11, and the like. The printing cylinder is configured to be capable of replacing a plate 20 on which an image for printing purpose is formed. The printing cylinder 11 has a printing cylinder cam 11*a*. The printing cylinder cam 11*a* is disposed at a position displaced in an axial direction so as to avoid interference with the ink roller group 10. A home position sensor 18 is provided in each of the printing units. The home position sensor 18 is configured so as to output a detection signal showing detection of the position of the printing cylinder cam 11*a* when the printing cylinder cam 11*a* that rotates in conjunction with rotation of the printing cylinder 11 has approached the home position sensor 18 most closely. A proximity sensor is used as the home position sensor 18. The home position sensor 18 is connected to a controller 19 to be described later.

Figure 3:
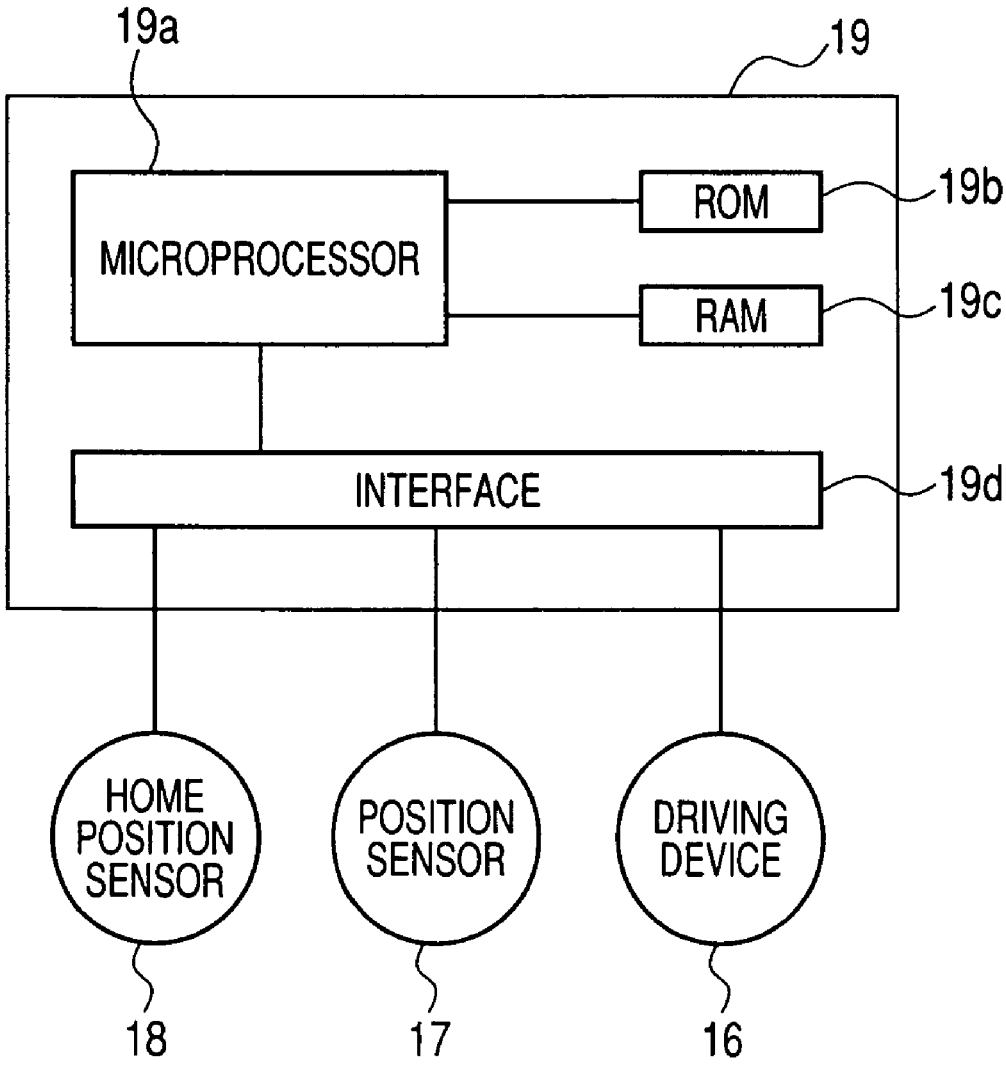
FIG. 3 is an exemplary schematic block diagram of a home position storage unit.

FIG. 3 shows an exemplary schematic block diagram of a mechanism for storing the home position of the printing cylinder according to the embodiment of the present invention. The mechanism includes a driving device 16 for driving the printing press, a position sensor 17 that detects a pulse from an encoder (not shown), which generates a pulse in synchronism with rotation of the driving device 16, in synchronism with rotation of the driving device 16 and generates position information including an amount of rotation of the driving device 16, the home position sensors 18 provided in the respective printing units, and control unit 19. The control unit 19 is configured by use of a microprocessor 19*a* that performs arithmetic operation or the like, ROM 19*b* that stores data and a predetermined program (a computing equation, a table, and the like), RAM 19*c* that stores various pieces of information about the number of rotations of a machine or the like, an interface 19*d* that mediates exchange of various signals between the microprocessor 19*a* and a device disposed outside of the control unit 19, and the like.

Figure 4:
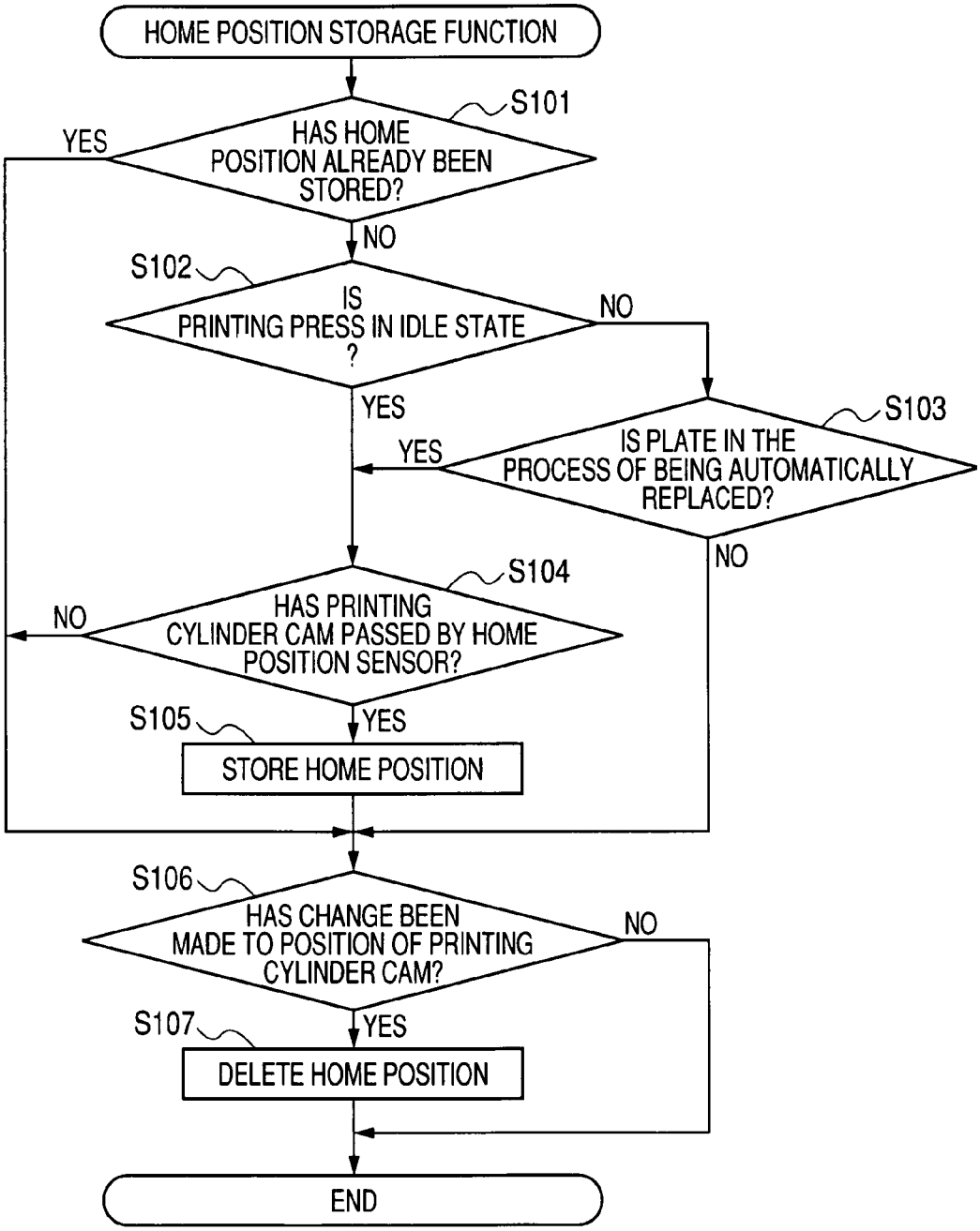
FIG. 4 is an exemplary flowchart achieved when operation for storing a home position is performed.

FIG. 4 is an exemplary flowchart employed at the time of performance of operation for storing the home position of the printing cylinder according to the embodiment of the present invention. Operation for storing the home position of a printing cylinder of the present embodiment will be described hereunder.

In step S101, a check is made as to whether or not the home position is stored. When the home position is stored (step S101: YES), processing proceeds to step S106 (described later). When the home position is not stored (step S101: NO), a check is made as to whether or not the printing press is in idle state (step S102). The word "idle state" means the state of trial run achieved before actual printing operation or the state of driving achieved before stoppage of the printing press after printing operation. For example, in the case of a printing press having the capability of printing 15000 sheets per hour during printing operation, the printing cylinder remaining idle achieves a rotational speed of about 3000 to 5000 per hour. When the printing process is not in idle state (step S102: NO), a check is made as to whether or not a plate is in the process of being automatically replaced (step S103). When the plate is not in the process of being automatically replaced (step S103: NO), processing proceeds to step S106 to be described later. When the plate is in the process of being automatically replaced (step S103: YES), processing proceeds to step S104 as in the case where step S102 is YES.

In step S104, a check is made as to whether or not the printing cylinder cam 11*a* provided on the printing cylinder 11 has passed by the home position sensor 18. Namely, in step S104, a check is made as to whether or not the home position sensor 18 has detected the printing cylinder cam 11*a*. When the printing cylinder cam 11*a* has passed by the home position sensor 18, namely, when the home position sensor 18 has detected the printing cylinder cam 11*a* (S104: YES), the home position is stored in step S105. When the printing cylinder cam 11*a* has not passed by the home position sensor 18, namely, when the home position sensor 18 has not detected the printing cylinder cam 11*a* (S104: NO), processing proceeds to step S106 to be described later. In relation to detection of the printing cylinder cam 11*a* performed by this home position sensor 18, the printing cylinder cam 11*a* is determined to have passed by the home position sensor 18 in the present embodiment when at least three position information, each of which is generated by the position sensor 17 at a point when the home position sensor 18 has detected the position of the printing cam 11*a*, are continuously identical. The reason for this is that, since only the home position achieved after issuance of the command for automatic replacement of a plate, namely, since only the home position achieved in the circumstance where the rotation of the printing cylinder is very slow during automatic replacement of a plate, is available under the conventional method, once storage of the home position is sufficient. However, the rotational speed of the printing cylinder achieved in an idle state is about 3000 to 5000 per hour and pretty fast, as previously mentioned. Thus, single detection of the home position may not be sufficient to ensure accuracy. Hence, the home position is ascertained a plurality of times as mentioned above. The number of coincidences can also be set to four times or more arbitrarily. However, test ascertainment conducted by the present inventors shows that sufficiently-accurate detection can be performed by means of three coincidences.

Next, a check is made in step S106 as to whether or not the position of the printing cylinder 11*a* has been changed. As previously mentioned, as a result of fine adjustment of the top-and-bottom direction of the printing cylinder 11, a relative position between the printing cylinder cam 11*a* and the home position sensor 18 may be changed before and after fine adjustment, and the printing cylinder 11 may not stop at the appropriate plate replacement position. Accordingly, a change in the position of the printing cylinder cam 11*a* is ascertained. Specifically, a sensor such as a proximity sensor (not shown) is disposed in the vicinity of the printing cylinder 11. When the printing cylinder 11 is subjected to fine adjustment, the sensor detects a change in the position of the printing cylinder 11 and outputs a signal to the controller 19, whereby the change in the position of the printing cylinder cam 11*a* is ascertained. In addition, a signal is output to the controller 19 even if the proximity sensor (not shown) located in the vicinity of the home position sensor 18 has detected a change in the position of the home position sensor 18, such as a case where the operator has opened the covers of the respective printing units and the operator's hand has erroneously touched the home position sensor 18, thereby having changed the position of the home position sensor 18. When the position of this printing cylinder cam 11*a* remains unchanged, a series of routines are completed. Memory of the home position is deleted in step S107, so long as the change has been made to the home position, and a home position is stored anew.

In the present embodiment, description has been given of a case where the printing press has the automatic plate replacement function of automatically performing a round of plate replacement operations as disclosed in Japanese Patent No. 2704558. However, the printing press may also be a printing press of type which enables manual replacement of a plate. In this case, before the printing cylinder 11 is stopped for replacing a plate, the home position of the printing cylinder 11 is stored.

The home position storage unit of the printing press of the present invention is not limited to the previously-described embodiment and is susceptible to various alterations or modifications within the scope of the appended claims. For instance, in the present embodiment, the printing press is the sheet-fed offset printing press. However, the present invention is not limited to this type of printing press. Any printing press is available, so long as the machine has a printing cylinder. For instance, a web (a roll of paper) offset printing press or a photogravure printing press may also be available.

The home position storage unit and the home position storage method for use with a printing press of the present invention are considerably useful for a printing press having a printing cylinder.

According to the present invention, the home position storage unit previously stores the home position before replacement of a plate. During replacement of the plate, the printing cylinder can be brought into a stop at the plate replacement position without detecting the position of the home position sensor anew. A time for replacement of a plate is shortened correspondingly, and a printing press which enables shortening of a preparation time for printing can be provided.

Further, according to the present invention, detection information detected by the position sensor at a point in time when the home position sensor has detected the position of the printing cylinder is extracted a plurality of times. A home position is stored only when a coincidence exists in the plurality of results of extraction. Therefore, storage of an erroneous home position, which would otherwise be caused in accordance with erroneous detection information when the printing cylinder is rotating at high speed, is prevented. Accordingly, a printing press capable of storing an accurate home position can be provided.

Still further, according to the present invention, the home position is stored in the course of the printing press is in idle state. The home position can be stored by use of a time achieved before or after printing operation. Accordingly, a printing press capable of efficiently storing a home position can be provided.

Still further, according to the present invention, a home position is stored in advance before operation for replacement of a plate. Hence, the printing cylinder can be brought into a stop at the plate replacement position without causing the home position sensor to detect a home position again during replacement of a plate. Accordingly, the time for replacement of a plate is shortened correspondingly, and a print preparation time can be shortened.

What is claimed is:

1. A printing press comprising:

a printing unit including a printing cylinder that is capable of replacing a plate;

a driving device that drives the printing unit;

a position sensor that detects a signal output from said driving device in synchronism with rotation of the driving device and generates position information including an amount of rotation of the driving device;

a home position sensor provided on the printing unit to detect a position of the printing cylinder in a rotating direction of the printing cylinder; and a home position storage unit that stores a home position of the printing cylinder by means of extracting position information generated by the position sensor at a point when the home position sensor has detected the position of the printing cylinder, wherein the home position storage unit stores the home position before an issuance of a command for replacement of the plate, wherein the position information at the point when the home position sensor has detected the position of the printing cylinder is extracted a plural number of times, wherein the home position storage unit stores the home position when a plural number of extracted position information are identical, and wherein the home position storage unit stores the home position of the printing cylinder only after ascertaining a plurality of identical position information consecutively generated by the position sensor at the point when the home position sensor has detected the position of the printing cylinder.

2. The printing press according to claim 1, wherein the home position storage unit stores the home position when the plural number of extracted position information are continuously identical.

3. The printing press according to claim 1, wherein the home position storage unit stores the home position when at least three extracted position information are identical.

4. The printing press according to claim 1, wherein the home position storage unit stores the home position when the printing press is in an idle state.

5. A home position storing method for use with a printing press, wherein the printing press comprising:

a printing unit including a printing cylinder that is capable of replacing a plate;

a driving device that drives the printing unit;

a position sensor that detects a signal output from said driving device in synchronism with rotation of the driving device and generates position information including an amount of rotation of the driving device; and a home position sensor provided on the printing unit to detect the position of the printing cylinder in a rotating direction of the printing cylinder, wherein the method comprises:

storing a home position of the printing cylinder by means of extracting position information generated by the position sensor at a point when the home position sensor has detected the position of the printing cylinder, the home position being stored before an issuance of a command for replacement of the plate, wherein the storing the home position comprises:

extracting the position information at the point when the home position sensor has detected the position of the printing cylinder a plural number of times; and storing the home position when a plural number of extracted position information are identical, and wherein the step of storing the home position when a plural number of extracted position information are identical further comprises:

storing the home position of the printing cylinder only after ascertaining a plurality of identical position information consecutively generated by the position sensor at the point when the home position sensor has detected the position of the printing cylinder.

6. The home position storing method according to claim 5, wherein the home position is stored when the plural number of extracted position information are continuously identical.

7. The home position storing method according to claim 5, wherein the home position is stored when at least three extracted position information are identical.

* * * * *